United States Patent [19]

Hamu

[11] 4,338,860

[45] Jul. 13, 1982

[54] HINGE AND SPACER APPARATUS

[76] Inventor: Kaino J. Hamu, 25142 Wandering La., El Toro, Calif. 92630

[21] Appl. No.: 132,389

[22] Filed: Mar. 21, 1980

[51] Int. Cl.[3] ..... B41F 15/00; B41F 15/18

[52] U.S. Cl. ..... 101/126; 101/114; 16/378

[58] Field of Search ..... 101/126, 123, 124, 407 R, 101/407 BP, 114, 127; 16/141, 54, 144, 50, 180, 182, 185 R, 185 H, 190, 378; 403/113, 117

[56] References Cited

U.S. PATENT DOCUMENTS

| | | | |
|---|---|---|---|
| 472,483 | 4/1892 | Loomis | 16/141 |
| 566,621 | 8/1896 | Rider et al. | 16/54 |
| 836,814 | 11/1906 | Klaczko | 101/126 |
| 2,046,872 | 7/1936 | Eaton | 101/407 BP |
| 3,098,431 | 7/1963 | Weaver | 101/126 |
| 3,263,603 | 8/1966 | Fuchs | 101/123 |
| 3,359,895 | 12/1967 | Forslund | 101/123 |

FOREIGN PATENT DOCUMENTS

| | | | |
|---|---|---|---|
| 83668 | 12/1956 | Netherlands | 101/407 R |

*Primary Examiner*—Edgar S. Burr
*Assistant Examiner*—C. A. Pearson
*Attorney, Agent, or Firm*—Boniard I. Brown

[57] ABSTRACT

Hinge apparatus for connecting first and second associated members which includes a pivot shaft, a bracket for releasably fixing the shaft to the first associated member, and a bracket for mounting the shaft on the second associated member for relative angular motion. The pivot shaft may be biased to at least one angular position by means of a third member fixed to the shaft and a fourth member carried on the second member. The third member may be a crank arm fixed to the shaft and a fourth member may be reciprocally mounted. The hinge apparatus may be part of a screen printing apparatus. The first member may be a frame and the second member may be a support. At least one spacer may be disposed intermediate the support and the frame at a point spaced from the pivot shaft. The support may include a platen dimensioned and configured to accept a generally planar axial extremity of each spacer.

14 Claims, 8 Drawing Figures

HINGE AND SPACER APPARATUS

BACKGROUND OF THE INVENTION

The invention relates to hinge connection assemblies and particularly to such assemblies which include detent apparatus and apparatus for positioning the members which are hinged together in angular relationship. Although the apparatus will be described primarily in the context of a screen printing apparatus it will be understood that it will have application a to wide variety of other apparatus and the description is intended to illustrate only one application for the invention. The prior art includes U.S. Pat. No. 3,608,854 which issued to the present applicant on Sept. 28, 1971. That patent relates to apparatus which is particularly suitable for releasably and hingably attaching a silk screen frame to a frame support.

The silk screen printing process involves the use of a printing screen mounted in a rectangular screen frame. This frame has side frame members or frame bars which carry means for gripping the screen about its edge and biaxially stretching the screen along the peripheral surface thereof. The actual silk screen printing process is well known and need not be explained here.

The prior art includes a variety of devices for holding the frame which in turn holds the silk screen. Some hinged apparatus has included counter weights to retain the frame in either an open position with respect to a support surface or a closed position proximate to a support surface. Such devices have not been wholly satisfactory because they have not provided the desired accurate positioning of the frame during and following repetitive "opening" and "closing" of the frame relative to the support. Various means have also been provided for spacing the frame from the platen which is a portion of the support surface. Such apparatus has also not been wholly satisfactory because the platen was not adequately stable. Such instability is highly undesirable because it may compromise the quality of the image produced by the silk screen process. The apparatus as generally known previously has also not been sufficiently flexible so that the frame was properly positioned with respect to a relatively wide variety of thicknesses of material on which an image was to be produced. For example, printed circuit boards intended to cooperate with the apparatus in accordance with the invention may vary substantially in thickness, and other members on which an image is to be produced will require an even wider range of operational flexibility because of the still greater variation in thickness of material on which an image is to be produced.

It is a primary object of the invention to provide a hinge assembly which includes a detent assembly for biasing a first hinged member into a predetermined angular relationship with a second hinged member.

Another object of the invention is to provide such apparatus which will in addition also bias the first hinged member into a second predetermined angular relationship with respect to the second hinged member, and the second predetermined angular relationship is different from the first predetermined angular relationship.

Another object of the invention is to provide apparatus which will be convenient to operate.

Another object of the invention is to provide apparatus which will conveniently accommodate materials having a wide range of thicknesses.

Still another object of the invention is to provide apparatus which will provide an absolutely stable mounting of the frame in a silk screen process with respect to the surface on which an image is to be produced.

Yet another object of the invention is to provide apparatus which will repetitively position a hinged member in precise angular relationship with respect to another member.

SUMMARY OF THE INVENTION

The foregoing objects and other objects and advantages which shall become apparent from the detailed description of the preferred embodiment are attained in a hinge mounting apparatus for connecting first and second associated members, a pivot shaft, and means for angularly biasing the members relative to each other, which comprises a spring biased element.

The hinge mounting apparatus for connecting first and second associated members may include a pivot shaft, and means for releasably fixing the shaft to the first associated member, means for mounting the shaft on the second associated member for relative angular motion, and first means for biasing the pivot shaft to at least one angular position which comprises a third member fixed to the shaft and a fourth member carried on the second member.

In one form of the invention the third member comprises a first crank arm fixed to the shaft and the fourth member is reciprocally carried on the second associated member. The hinge apparatus may further include a second means for biasing the pivot shaft. The fourth member may be urged by a first helical compression spring toward the pivot shaft. The second means for biasing may comprise a fifth member which is mounted for reciprocal axial motion and may be axially biased by a second helical compression spring urging the fifth member toward the pivot shaft. The means for fixing the shaft to the first member may comprise a plurality of clamping members.

In another form of the invention screen printing apparatus includes a first member, a second member, a pivot shaft, and means for fixing the shaft to the first member. Means are provided for mounting the shaft on the second member for relative angular motion and for biasing the pivot shaft to at least one angular position, which comprises a third member fixed to the shaft and a fourth member carried on the second member.

The third member may comprise a first crank arm fixed to the shaft and the fourth member may comprise a reciprocally mounted element. The apparatus may further include a second means for biasing the pivot shaft. The fourth member may be axially biased by a first helical compression spring toward the pivot shaft. The second means for biasing may comprise a fifth member which is mounted for reciprocal axial motion and a second helical compression spring. The fifth member may be axially biased by the second helical compression spring toward the pivot shaft. The means for fixing the shaft to the first member may comprise a plurality of clamping members. The first member may be a frame and the second member may be a support.

The support includes at least one spacer disposed intermediate the support and the frame at a point spaced from the pivot shaft. The apparatus may include at least a second spacer and each spacer may comprise an elongated threaded member having means for locking the member relative to the support. The elongated member may include a generally planar axial extremity. The support may include a platen and a base and the platen may include first and second recesses dimensioned and configured to accept the generally planar axial extremity of each spacer with one face thereof in flush relationship with a face of the platen. The platen may be mounted for sliding movement relative to the base. The platen may be spring biased on the base toward at least two sides thereof. A first bracket may be carried on the underside of the platen and a first elongated threaded member carried on the base which cooperates with a surface of the first bracket. The apparatus may also include a second bracket carried on the underside of the platen and a second elongated threaded member carried on the base which cooperates with the second bracket; the first and second elongated threaded members may be disposed generally at right angles. A third bracket may be carried on the platen and a third elongated threaded member may be carried on the base of the support; the second and third elongated threaded members may be disposed in generally parallel relationship. The second and third brackets may have respective surfaces thereof which cooperate with respectively the second and third elongated threaded members and the surfaces are disposed in generally oblique relationship to the platen.

BRIEF DESCRIPTION OF THE ACCOMPANYING DRAWING

DESCRIPTION OF THE PREFERRED EMBODIMENT

Figure 1:
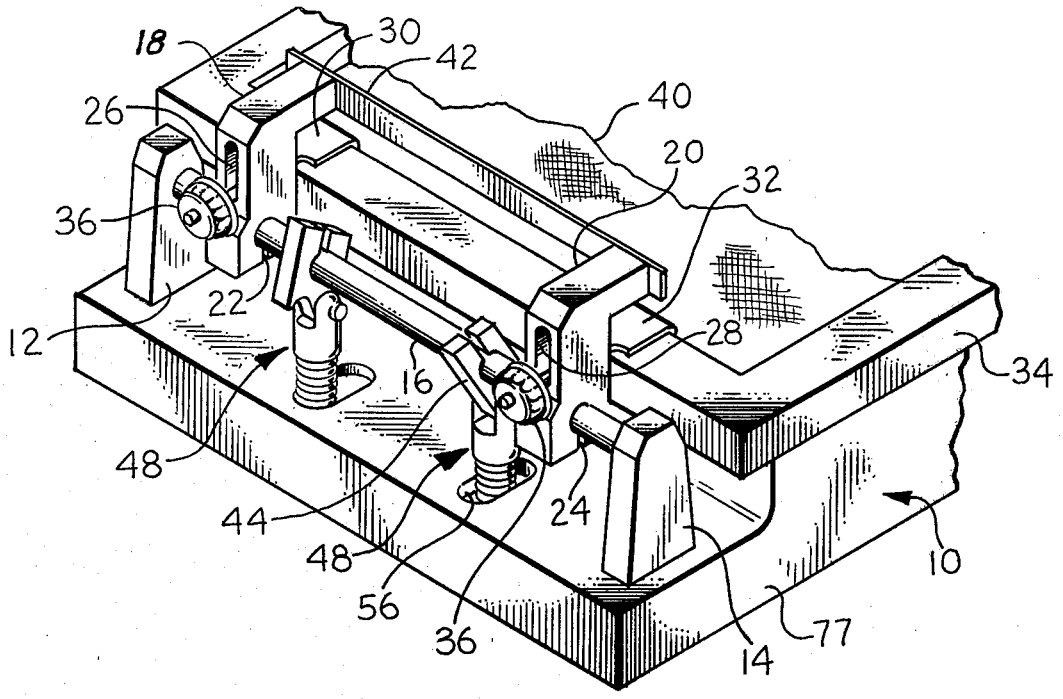
FIG. 1 is a perspective view primarily of the rear and left (with respect to the front) side of apparatus in accordance with the invention.
Figure 2:
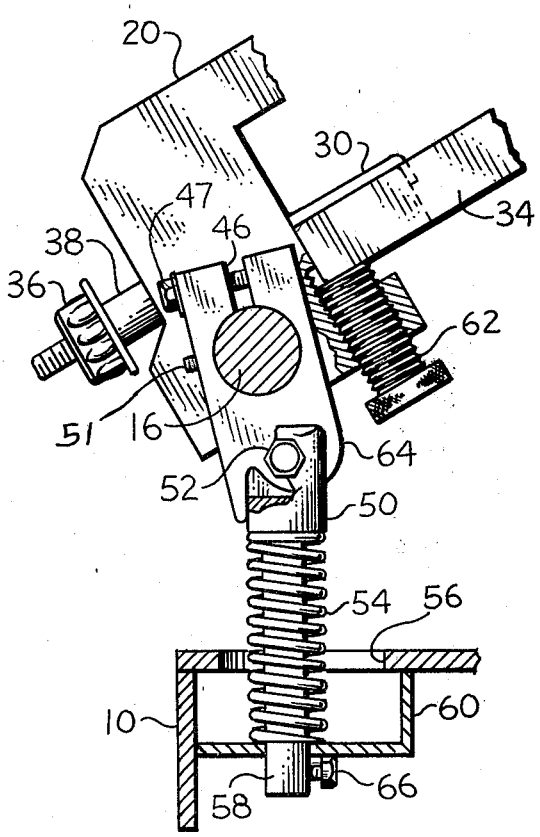
FIG. 2 is an elevational view in partial section of a portion of the apparatus shown in FIG. 1 taken along a plane extending through and perpendicular to the medsection of the pivot shaft.
Figure 3:
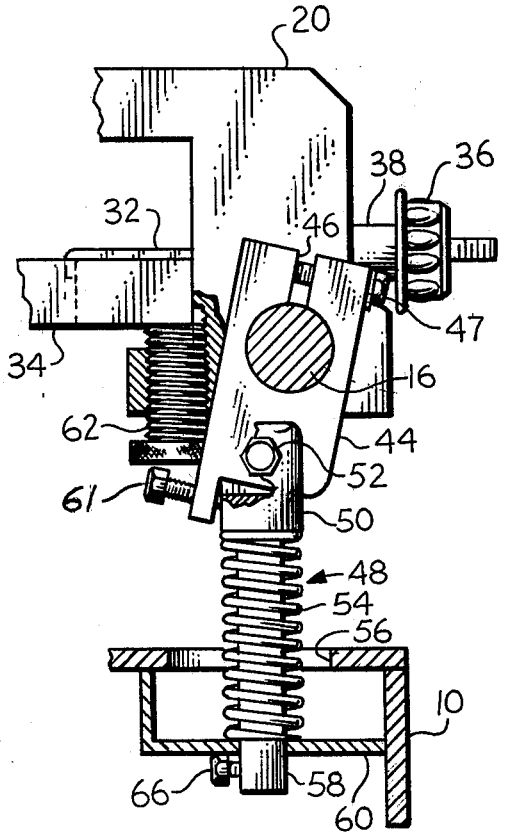
FIG. 3 is an elevational view in partial section of another portion of the apparatus in FIG. 1, taken along a plane extending through and perpendicular to the midsection of the pivot shaft with a different angular orientation of the hinged member.

Referring now to FIGS. 1, 2, and 3 there is shown a support 10 upon which are carried bearing blocks 12 and 14 which each include self lubricated ball bearings (not shown) which support a pivot shaft 16 for rotation relative to the support 10. Clamp members 18, 20 are respectively provided with openings 22, 24 which engage the pivot shaft 16. Bolts (not shown) extend across the throat of the openings 22, 24 to positively clamp the clamp members 18, 20 to the pivot shaft 16. Each clamp member 18, 20 is provided with a generally vertical slot 26, 28. Extending through the slots 26, 28 are L-shaped members 30, 32 which engage one side of the frame 34. Each L-shaped member 30, 32 is provided with a threaded axial extremity which cooperates with internally threaded locking member 36. Each of the threaded members 36 may include a discrete axially elongated "washer" 38 or the "washer" may be integral with each locking member 36. It will be understood that the silk screen 40 is carried on the frame 34 and that a generally planar element 42 extends intermediate the clamp members 18, 20.

A first biasing assembly includes a crank arm 44 having an opening 46 which extends around the pivot shaft 16 and which cooperates with a bolt 47 which secures the crank arm 44 to the pivot shaft 16.

Figure 7:
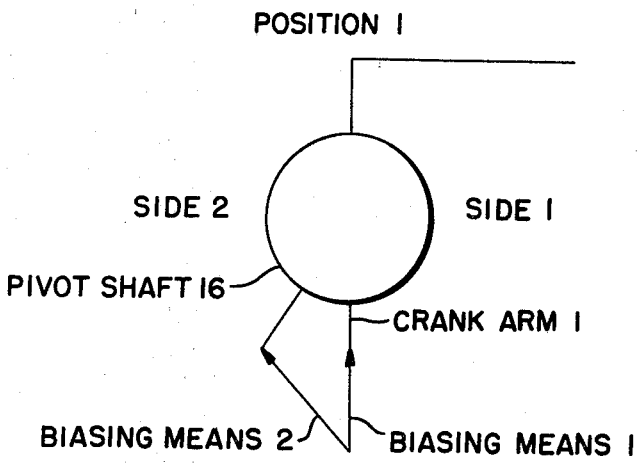
FIGS. 7 and 8 are diagrammatic representations of the biasing means on the crank arms and pivot shafts to position the screen in null and open positions.

A biasing assembly 48 cooperates with the crank arm 44. The biasing assembly 48 includes an elongated member 50 having a yoke shaped upper extremity in which is disposed a bolt or pin 52 which extends through the crank arm 44. The elongated member 50 extends through a cylindrical compression spring 54 which in turn extends through an opening 56 in the support 10. A sleeve 58 is fixed to a bracket 60 which is in turn fixed to the support 10. It will be seen that the effect of the spring 54 is to urge the upward extremity of the elongated member 50, and particularly the bolt or pin 52, upward and thus rotate the crank arm 44 clockwise as viewed in FIG. 3. FIG. 7 diagrammatically illustrates the action of the biasing means on the crank arm to maintain the screen frame in the position of FIG. 3. A bolt 61 which is carried by the crank arm 44 serves as an asjustable stop to limit the travel produced responsive to the spring 54. The clamp member 20 is provided with an adjustment bolt 62 which engages the frame 34 and cooperates with the L-shaped member 32 to positively retain the frame 34.

Figure 8:
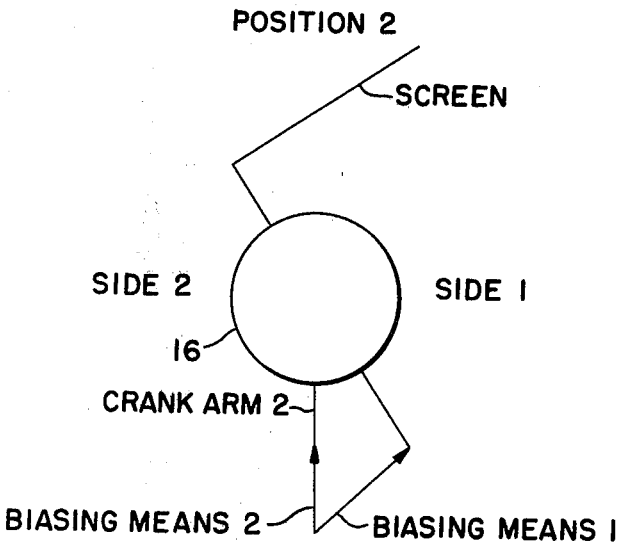

Referring particularly now to FIG. 2, there is shown the apparatus cooperating with a crank arm 64 which is generally similar to the crank arm 44. As in the description of the crank arm 44 (and its cooperating elements), an opening 46 engages the pivot shaft 16 and a bolt 47 insures positive cooperation therebetween. An elongated member 50 is provided with a pin or bolt 52 which extends through crank arm 64. A spring 54 extends through an opening 56. A sleeve 58 is fixed to a bracket 60 and a locking screw 66 secures the lower axial extremity of the elongated member 50 to the sleeve 58. It will thus be seen that the spring 54 urges the pin or bolt 52 upwards and urges the crank arm 64 to rotate in a counter clockwise (as viewed in FIG. 2) direction. It will be further understood that the crank arm 64 functions to hold the frame 34 in a so called "open" position where it has an angle of approximately sixty degrees with the upper surface of the support 10. The crank arm 44 is ordinarily positioned so that it will bias the frame 34 into a position where it is generally parallel to the upper surface of the support 10. A set screw 51 is carried by crank arm 64 to positively fix the relationship between the crank arm 64 and the pivot shaft 16. The "null" positions of the frame 34 (which are generally horizontal and at a sixty degree angle with respect to a horizontal plane) are determined by the bolt 61 and also the geometry and angular orientation of the crank arms 44 and 64 with respect to pivot shaft 16. FIG. 8 diagrammatically illustrates the action of the biasing means on the crank arm to maintain the screen frame in the position shown in FIG. 2. More specifically, in each "null" position the force produced by one of the springs 54 will extend very close to the axis of rotation of the pivot shaft 16. As best seen in FIGS. 2 and 3, a bolt 62 cooperates with the clamp member 20 to retain the frame 34.

Figure 4:
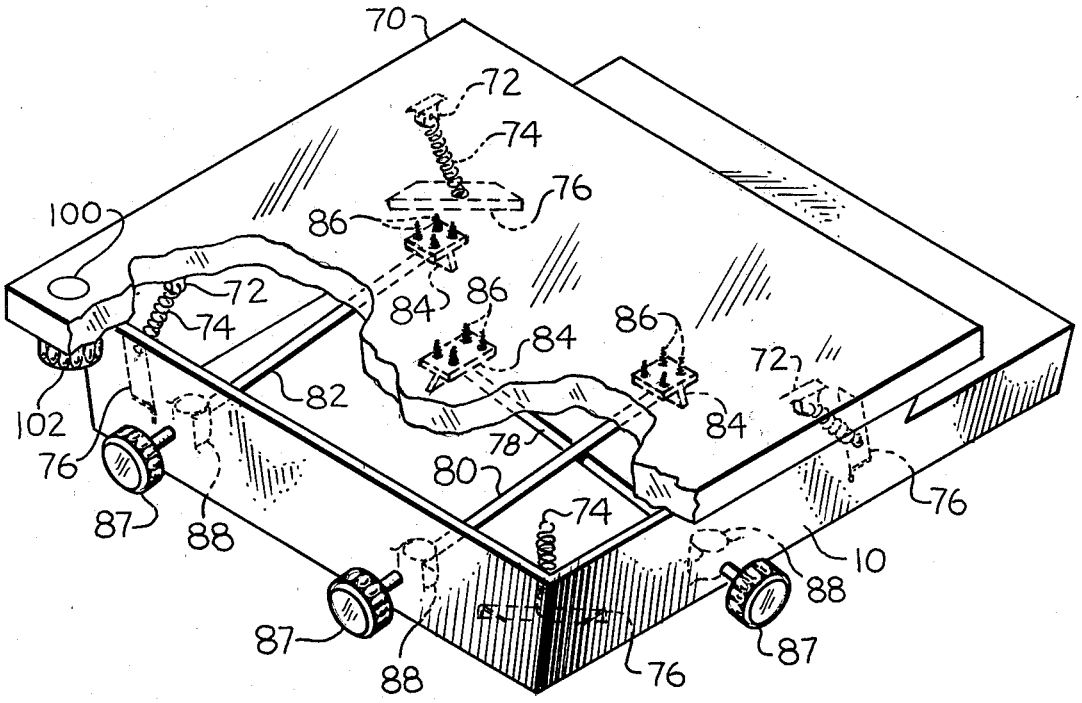
FIG. 4 is a perspective view of a transparent platen and support structure, and particularly the front and right sides thereof.
Figure 5:
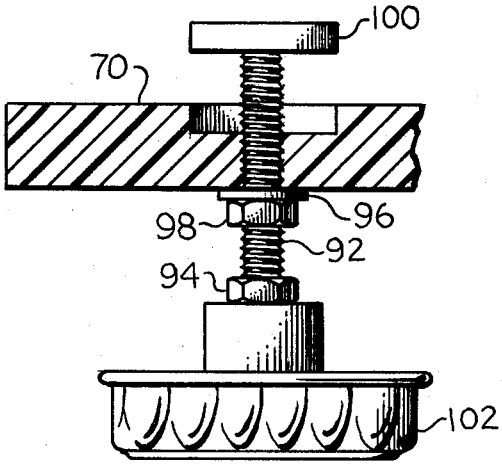
FIG. 5 is an elevational view of the portion of the platen shown in FIG. 4 and a spacer assembly.
Figure 6:
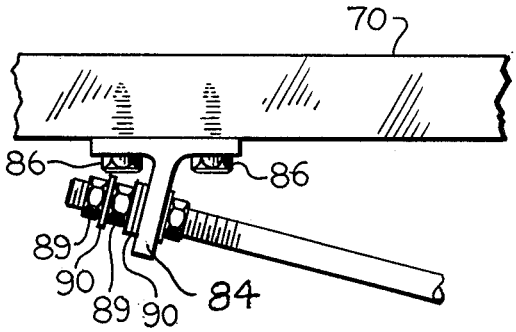
FIG. 6 is an elevational view of a portion of the platen, showing in more detail a bracket on the underside of the platen and an inclined threaded member.

Referring now to FIGS. 4, 5, and 6, there is shown a support 10 which includes a platen 70 which is carried for sliding movement on the base 77 of the support 10. The platen 70 in one form of the invention is transparent plastic material having a thickness of one inch. The platen 70 is provided with eye hooks 72, disposed on the lower face of the platen 70, which are engaged by tension springs 74 which extend to anchor members 76 which are carried by the base 77 of the support 10.

The position of the platen 70 may be varied (within the latitude determined by the springs 74) by elongated members 78, 80, 82. Each of these members cooperates with an oblique surface of a bracket 84 which is fixed to the platen 70 by means of screws 86, 86. Each threaded elongated member 78, 80, 82 is carried by a mount 88 which is in turn carried by the base 77 of the support 10. The mount 88 has internal threads (not shown) which cooperate with the external threads of the threaded elongated members 78, 80, 82. A handle 87 is fixed to the axial extremity of the threaded elongated members 78, 80 and 82 which is outside of the base 77 of the support 10. It will be seen that the rotation of the handles 87 on threaded elongated members 82, 80 in the same direction will tend to move the platen 70 in a path which is generally parallel to the elongated members 80, 82. The rotation of the handle 87 on elongated member 78 will similarly tend to move the platen 70 in a direction which is generally parallel to the elongated member 78. It will be understood that the elongated members 78, 80 and 82 are fixed to brackets 84 in a manner generally illustrated in FIG. 6 wherein elongated member 78 is fastened to the bracket 84 by mean of nuts 89 and washers 90.

Referring now to FIG. 5, there is shown a spacer assembly which includes an elongated threaded member 92 which may in one form of the invention be a bolt having a head 94 and carried thereon a washer 96 and a nut 98 and having a generally planar support 100 at the upper axial extremity thereof. A handle 102 is disposed at the lower axial extremity of elongated threaded member 92. In operation, the threaded member 92 is rotated and the exterior threads thereof engage the interior surface of the platen 70 to raise the generally planar support 100. A lock nut 98 limits maximum axial travel in the upwards direction. It will be understood that an assembly comprising elements 92, 94, 96, 98, 100 and 102 is also disposed at the broken away corner of the platen 70 which is shown in FIG. 4. Generally planar support 100, of course, cooperates with the frame 34 to vary the height of the frame 34 relative to an article on which an image is to be produced. For example, a printed circuit board of given dimensions may be positioned on the platen 70, after which the silk screen 40 is disposed over it. The mounting structure for the frame 34 allows the adjustment thereof with respect to the frame 34 and further securely mounts the frame 34.

The apparatus in accordance with the invention ordinarily will be manufactured of metal construction except for the transparent plastic platen 70 and the base 77 which may be manufactured of wood or metal.

In various forms of the invention multiple cam members and cam followers may be used instead of the crank arm construction illustrated. In some forms of the invention the table top or platen may be back lighted. The platen may also be provided with a vacuum cooperating with the surface of the platen 70.

The invention has been described with reference to its illustrated preferred embodiment. Persons skilled in the art of constructing silk screen apparatus may, upon exposure to the teachings herein, conceive variations in the mechanical development of the components therein. Such variations are deemed to be encompassed by the disclosure, the invention being delimited only by the appended claims.

The inventor claims:

1. Hinge apparatus for connecting first and second associated members which comprises:

a pivot shaft pivotal between a first rotative position and a second rotative position, means for releasably fixing said shaft to the first associated member, means for mounting said shaft on the second associated member, first biasing means operative to bias said pivot shaft toward said second rotative position only when said pivot shaft is not in said first rotative position, and second biasing means operative to bias said pivot shaft toward said first rotative position only when said pivot shaft is not in said second rotative position, each of said biasing means including a crank arm fixed to said shaft, a reciprocally mounted element and a helical compression spring urging said reciprocally mounted element which in turn biases its associated crank arm, said crank arm of said first biasing means being rotatively positioned relative to said shaft so that when said pivot shaft is in said first rotative position the force of the helical compression spring of said first biasing means is directed substantially through the axis of said pivot shaft, and when said pivot shaft is not in said first rotative position the force of said associated helical spring of said first biasing means is displaced to a first side of the axis of said pivot shaft so as to bias said pivot shaft toward said second rotative position, said crank arm of said second biasing means being rotatively positioned relative to said shaft differently than said crank arm of said first biasing means so that when said pivot shaft is in said second rotative position the force of the helical compression spring of said second biasing means is directed substantially through the axis of said pivot shaft and when said pivot shaft is not in said second rotative position the force of said associated helical spring of said second biasing means is displaced to a second side of the axis of said pivot shaft, whereby the helical compression springs are always acting to rotate said pivot shaft in opposite directions when said pivot shaft is between its first and second rotative positions.

2. The apparatus as described in claim 1, wherein:

said means for releasably fixing said shaft to said first member comprises a plurality of clamping members.

3. Screen printing apparatus which comprises:

a first member;

a second member;

a pivot shaft pivotal between a first rotative position and a second rotative position;

means for fixing said shaft to said first member;

means for mounting said shaft on said second member;

first biasing means operative to bias said pivot shaft toward said second rotative position only when said pivot shaft is not in said first rotative position; and second biasing means operative to bias said pivot shaft toward said first rotative position only when said pivot shaft is not in said second rotative position;

each of said biasing means including a crank arm fixed to said shaft;

a reciprocally mounted element and a helical compression spring urging said reciprocally mounted element which in turn biases its associated crank arm;

said crank arm of said first biasing means being rotatively positioned relative to said shaft so that when said pivot shaft is in said first rotative position the force of the helical compression spring of said first biasing means is directed substantially through the axis of said pivot shaft;

and when said pivot shaft is not in said first rotative position the force of said associated helical spring of said first biasing means is displaced to a first side of the axis of said pivot shaft so as to bias said pivot shaft toward said second rotative position;

said crank arm of said second biasing means being rotatively positioned relative to said shaft differently than said crank arm of said first biasing means so that when said pivot shaft is in said second rotative position the force of the helical compression spring of said second biasing means is directed substantially through the axis of said pivot shaft and when said pivot shaft is not in said second rotative position the force of said associated helical spring of said second biasing means is displaced to a second side of the axis of said pivot shaft;

whereby the helical compression springs are always acting to rotate said pivot shaft in opposite directions when said pivot shaft is between its first and second rotative positions.

4. The apparatus as described in claim 3, wherein:

said means for fixing said shaft to said first member comprises a plurality of clamping members.

5. The apparatus as described in claim 4, wherein:

said first member comprises means for holding an associated frame and said second member is a support.

6. The apparatus as described in claim 5, wherein:

said support includes at least one spacer disposed intermediate said support and an associated frame carried by said means for holding an associated frame at a point spaced from said pivot shaft.

7. The apparatus as described in claim 6, wherein:

said apparatus includes at least a second spacer and each spacer comprises an elongated threaded member having means for locking said member relative to said support.

8. The apparatus as described in claim 7, wherein:

said elongated member includes a generally planar axial extremity.

9. The apparatus as described in claim 8, wherein:

said support includes a platen and a base, said platen including first and second recesses dimensioned and configured to accept said generally planar axial extremity of each spacer with one face thereof in flush relationship with a face of said platen.

10. The apparatus as described in claim 9, wherein:

said platen is mounted for sliding movement relative to said base and is spring biased on said base toward at least two sides thereof.

11. The apparatus as described in claim 10, further including:

a first bracket carried on the underside of said platen and a first elongated threaded member carried on said base which cooperates with a surface of said first bracket.

12. The apparatus as described in claim 11 further including:

a second bracket carried on the underside of said platen and a second elongated threaded member carried on the base which cooperates with said second bracket, said first and second elongated threaded members being disposed generally at right angles.

13. The apparatus as described in claim 12 further including:

a third bracket carried on said platen and a third elongated threaded member carried on said base of said support, said second and third elongated threaded members being disposed in generally parallel relationship.

14. The apparatus as described in claim 13 wherein:

said second and third brackets have respective surfaces thereof cooperating with respectively said second and third elongated threaded members and said surfaces are disposed in generally oblique relationship to said platen.

* * * * *